United States Patent [19]

Garcia

[11] Patent Number: 4,514,001

[45] Date of Patent: Apr. 30, 1985

[54] ELECTRO-MECHANICAL LOCK

[75] Inventor: Antonio D. Garcia, Alcorcon, Spain

[73] Assignee: Segutronica, S.A., Alcorcon, Spain

[21] Appl. No.: 621,123

[22] Filed: Jun. 14, 1984

Related U.S. Application Data

[63] Continuation-in-part of Ser. No. 322,622, Nov. 18, 1981, abandoned.

[30] Foreign Application Priority Data

Nov. 21, 1980 [ES] Spain ..... 254.587[U]

[51] Int. Cl.[3] ..... E05B 15/02; E05C 3/16

[52] U.S. Cl. ..... 292/341.16; 292/201; 292/221; 292/DIG. 49

[58] Field of Search ..... 292/341.16, 341.17, 292/228, 221, 29, DIG. 49, 201

[56] References Cited

U.S. PATENT DOCUMENTS

| | | | |
|---|---|---|---|
| 352,154 | 11/1886 | Rousseau | 292/341.16 |
| 508,518 | 11/1893 | Johnson | 292/341.16 |
| 791,113 | 5/1905 | Staehle | 292/341.16 |
| 881,658 | 3/1908 | Bowman | 292/210 X |
| 1,184,498 | 5/1916 | Wells | 292/341.17 |
| 1,528,515 | 3/1925 | Taylor | 292/223 X |
| 3,188,129 | 6/1965 | Broch | 292/341.16 |
| 4,056,276 | 11/1977 | Jarvis | 292/DIG. 49 X |
| 4,056,277 | 11/1977 | Gamus et al. | 292/341.16 |
| 4,182,539 | 1/1980 | Busch | 292/DIG. 49 X |
| 4,211,443 | 7/1980 | Butts et al. | 292/341.16 |

FOREIGN PATENT DOCUMENTS

| | | | |
|---|---|---|---|
| 46394 | 3/1889 | Fed. Rep. of Germany | 292/341.16 |
| 177383 | 10/1906 | Fed. Rep. of Germany | 292/341.16 |

*Primary Examiner*—Gary L. Smith
*Assistant Examiner*—Russell W. Illich

[57] ABSTRACT

The present invention refers to an improved electro-mechanical lock wherein a connecting rod is articulated at its ends to the bolt and to a lever or crank, the latter being able to rotate about the axis of articulation of the connecting rod, with the special feature that the basic assembly formed by the bolt-connecting rod is constantly impelled by the action of a tension spring which has one of its ends anchored to the end of the articulation shaft of the connecting rod and of the crank. Provision has been made for a counterfort on one lateral of the general casing or housing, on which counterfort there is an offset intended to house the head to the above-mentioned shaft in the last place, in the open position, while in the closed position the head of the shaft is blocked and with it the whole connecting rod-bolt assembly by means of a ratchet which covers the entrance to the cavity or offset made in the counterfort, the ratchet being displaced from the closed position by means of a rigid rod moved by the action of an electromagnet, so that when the said action ceases the ratchet tends to recover the closed position by means of an antagonistic spring placed between the rod and the casing.

8 Claims, 3 Drawing Figures

ELECTRO-MECHANICAL LOCK

This is a continuation-in-part of Ser. No. 322,622, filed Nov. 18, 1981, abandoned.

This invention relates to an improved electro-mechanical lock. Its purpose is to improve a lock of the same type registered in Spain as Ulility Model 251,102, whose owner is the applicant for registration of the model with which we are concerned.

For this reason, and in order to be able to establish the fundamental points and points of novelty offered by the invention, a synthesis will first be made of Spanish Utility Model number 251,102, so that on the basis of its characteristics it will be possible to establish the new characteristics which are the object of the invention The electro-mechanical lock described in Spanish Utility Model 251,102 is constituted on the basis of a casing in which the relevant components or parts are situated, among which the following are fundamentally outstanding: a bolt, a thumb latch and a connecting rod articulated to the bolt, apart from the corresponding mechanism which make the movement of these parts possible. The bolt is mounted between two lateral flanges or lugs fixed to the casing, and it is mounted in such as way that it can rotate about its own axis of articulation. The bolt is connected in turn to the above-mentioned connecting rod and also has the possibility of rotating about another axis of articulation of the said connection rod.

The assembly formed by the aforesaid bolt and the connecting rod is under tension from a spring which envelopes the connecting rod. The assembly allows two positions, one closed, in which the bolt is lowered and the other open, in which the bolt is raised and unblocked.

In the closed position the bolt can be blocked or unblocked by means of a ratchet operated by an electromagnet whose armature is connected to the said ratchet by a rigid rod.

The thumb latch is cylindrical in shape and is mounted in such a way that it can displace rectilinearly, availing of a spring which is connected to a trip which, when moved, pushes and lowers the bolt by means of a roller or lug provided on one side of the bolt.

Basically and generally, the above-mentioned characteristics are those which define Spanish Utility Model 251,102. Therefore, on the basis of these characteristics, the object of the invention is mainly characterized by the fact that it has the following differences or innovations.

In the lock to which the invention refers, the connecting rod is connected to the bolt and also to a kind of lever or crank by means of a shaft which is under tension from a tension spring. That is to say, in this case there is a crank or lever and in addition the bolt-connecting rod assembly is under tension from a spring which does not envelope the connecting rod as occurs in Spanish Utility Model Number 251,102.

Another difference is based on the mechanism which constitutes the thumb latch, since in this case, that is to say in the lock to which the invention relates, the thumb latch is capable of rotating about its axis, offering resistance to this rotation by means of a spring which opposes it. In its rotation it tends to displace the trigger, since both are connected by a spring, all of which is used to lower the bolt in the act of locking.

The disclosure of Spanish Utility Model No. 251,102 is hereby incorporated herein by this reference.

To complete the description that will be given hereinafter, and for the purpose of aiding a better understanding of the characteristics of the invention, drawings are included which depict a preferred embodiment, wherein.

Figure 1:
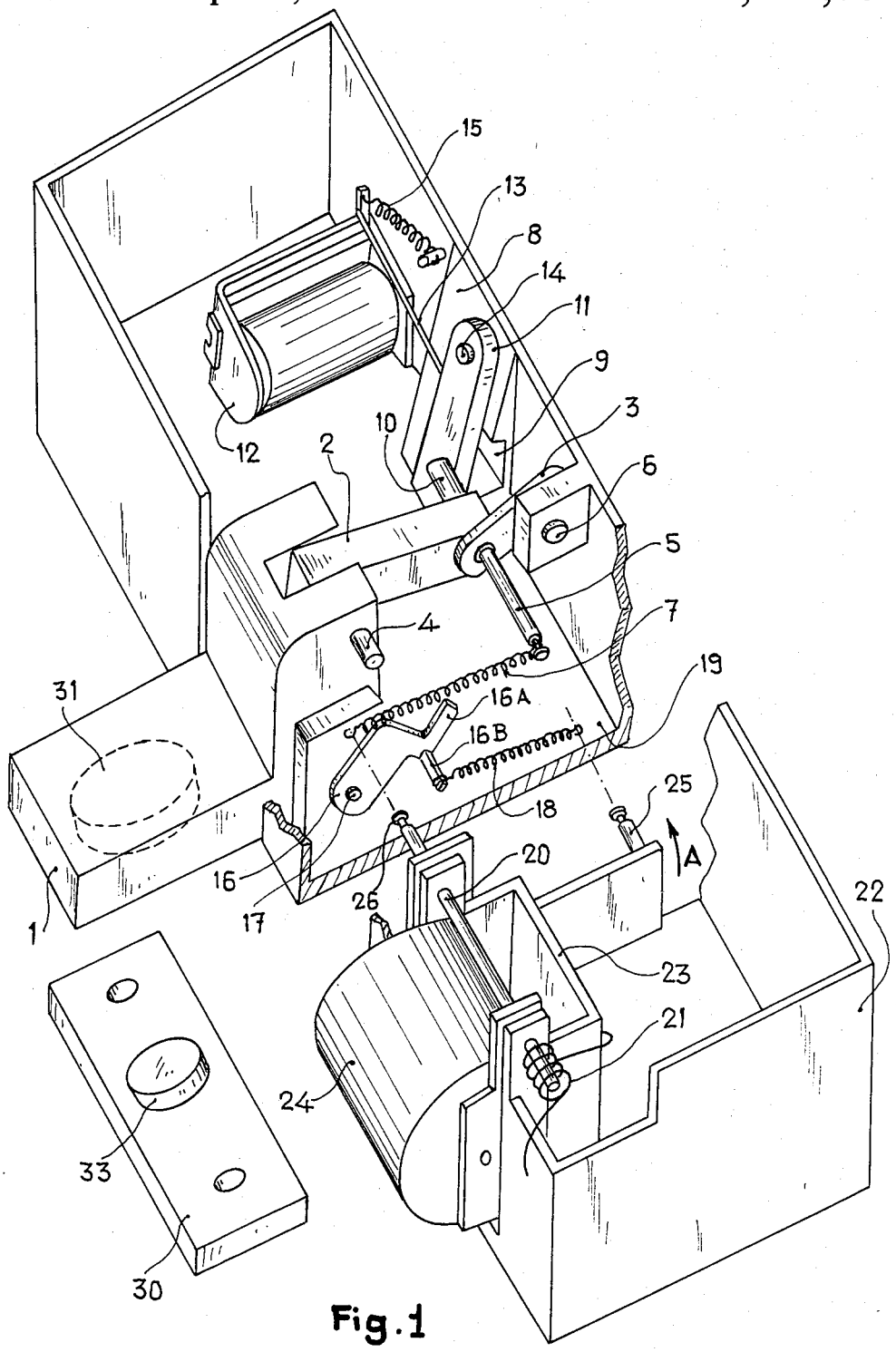
FIG. 1 is a cut-away of the lock without its cover in place in order to allow all the parts and mechanisms to be clearly seen.
Figure 2A:
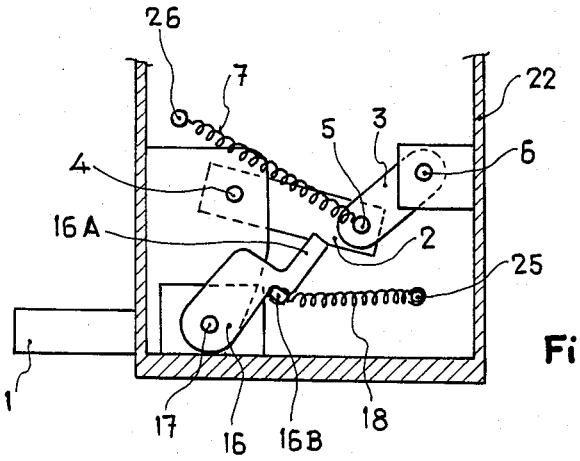
FIGS. 2A and 2B are section views taken through the lock showing it in two operational positions.

FIGS. 1 and 2A show the lock with its bolt 1 in locked or extended position. Housing 22 of the main part of the lock may be included in a door frame (not shown) for instance, while piece 30 may be mounted on the associated door (also not shown). If desire, piece 30 may be provided with a protrusion 33 which engages with a cavity 31 in bolt 1.

Figure 2B:
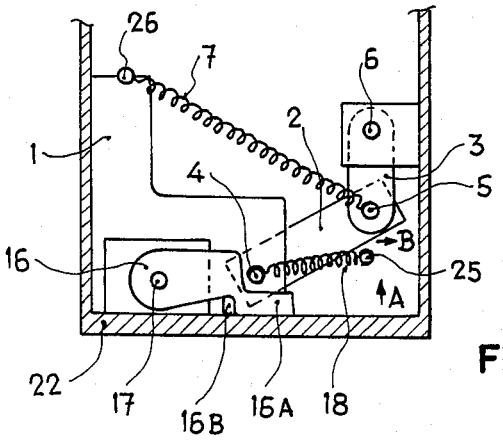

The bolt 1 is rotatably mounted on a shaft 17 for rotating the bolt into an open position depicted in FIG. 2B. The bolt 1 is connected to a connecting rod 2 and the latter is connected in turn to a crank 3 by means of shafts 4 and 5, respectively. Crank 3 is articulated to housing 22 by means of a shaft 6. The assembly formed by the bolt-connecting rod-crank 2,3 is constantly under tension through the action of a tension spring 7 attached to the shaft 5 and anchored at a pin 26 so that this assembly is impelled, causing bolt 1 to adopt one of two possible positions, open or extended. Spring 7 is shown separated from pin 26 in FIG. 1 due to the cut-away view of the internals of the lock. As will be seen, the rod-crank assembly 2,3 is an over-center type device with spring 7 reaching its fullest extension when bolt is in between its open and closed positions.

Furthermore, the posterior lateral wall of the lock is provided with a region 8 of greater thickness giving it greater strength. In region 8 there is a channel 9 to receive the head 10 of the shaft 5 when bolt 1 is rotated on its axis 17 to the open position depicted in FIG. 2B, while in the extended position depicted in FIG. 1 the head 10 is blocked by a ratchet 11 which conceals or covers the channel 9 of region 8 so that the head 10 of the shaft 5 cannot penetrate into it, thereby locking bolt 1 in its extended position.

The ratchet 11 is rotated on its axis 14 by the action of an electromagnet 12 acting upon a rod 13 causing the ratchet to uncover channel 9. When the electromagnet 12 is de-energized the ratchet 11 tends to return to its position covering channel 9 through the action of a spring 15.

The end of the shaft 4 protrudes from the bolt 1 so that in the open position it rests on an arm 16A of the trigger 16 which in turn can also rotate about the axis 17. The trigger 16 also has a lug 16B which is connected to one end of a spring 18.

A thumb latch is provided which is pivotally mounted on a shaft 20. The thumb latch is constantly under pressure by means of a torsion spring 21 which causes it to tend to emerge from the casing or housing 22 of the lock.

The roller 24 of the thumb latch is mounted on a support 23 which support has a lug 25 which attaches to the other end of spring 19. Again, spring 19 is shown separated from lug 25 in FIG. 1 due to the cut-away view of the internals of the lock. When the lock is in its open position and the thumb latch then is depressed into the casing, it rotates about its axis 20 and causes the lug 25 to raise in the direction of Arrow A and flexibly pull the trigger 16 by means of the spring 18, thereby tending to rotate the bolt from the open position of FIG. 2B to the closed position of FIGS. 1 and 2A. At first, this movement is hindered by spring 7 since as lug 16A starts to rotate bolt 1 by acting on shaft 4, bolt 5 is urged in the direction of Arrow B (FIG. 2B) causing spring 7 to offer greater resistance. However, by appropriately selecting the spring constants, spring 18 will be able to overcome this initial resistance offered by spring 7. Due to the over-center design of the rod-crank assembly 2, 3, the thumb latch need only be depressed a small distance and bolt 5 need only move a short distance in the direction of arrow B from the position shown in FIG. 2B before bolt 5 goes over center and spring 7 then assists in urging bolt 1 to its closed position.

The following advantages are deduced from the constitution and functioning of the lock described:

The lock can be small in width.

Friction in the connecting rod and thumb latch is reduced.

The thumb latch offers different degrees of resistance to closing and opening, being weak in the case of closing and strong in the case of opening.

What is claimed is:

1. An electro-mechanical lock comprising:

(a) a housing having a wall with a channel therein;

(b) a bolt rotatably mounted on said housing, said bolt being rotatable between extended and open positions;

(c) a connecting rod articulated to said bolt;

(d) a crank articulated to said connecting rod by means of a pin having a head extends away from said connecting rod, said crank further being articulated to said housing;

(e) a spring coupled to said pin;

(f) said crank and connecting rod providing an over-center arrangement such that said spring is fully extended when said bolt is between its extended and open positions and said spring urges said bolt to both its extended and open positions;

(g) said head of said pin moving into said channel when said bolt is rotated to its open position;

(h) means for selectively blocking said channel whereby said pin is selectively blocked from entry into an exit from said channel; and (i) an electromagnet for operating said blocking means.

2. An electro-mechanical lock as claimed in claim 1, further including a thumb wheel mounted in an opening in said housing; first means for urging said thumb wheel to extend from said housing and through said opening; and second means for urging said bolt to rotate to its extended position in response to movement of said thumb wheel against said first urging means.

3. The lock as claimed in claim 2, wherein said second urging means includes a rotatably mounted trigger mechanism including an arm which engages said bolt and a second spring coupling said arm to said thumb wheel whereby movement of said thumb wheel against said first urging means causes said arm of said trigger mechanism to rotate on its axis, engage said bolt, and rotate said bolt to its extended position.

4. The lock as claimed in claim 5 further including a single shaft for rotatably mounting both said bolt and said trigger mechanism to said housing.

5. The lock as claimed in claim 4, wherein said trigger mechanism further includes a second pin disposed essentially parallel to said shaft and wherein said second spring is coupled to said second pin.

6. The lock of claim 5 wherein the first mentioned pin is disposed parallel to said shaft.

7. The lock of claim 6 wherein said thumb wheel offers a greater resistance opening the lock than to closing the lock.

8. The lock of claim 2 wherein said thumb wheel offers a greater resistance opening the lock than to closing the lock.

* * * * *